US009220378B2

(12) United States Patent
Urban

(10) Patent No.: US 9,220,378 B2
(45) Date of Patent: Dec. 29, 2015

(54) DEVICE FOR HOLDING SOAP

(71) Applicant: Aleksandra Urban, Levittown, PA (US)

(72) Inventor: Aleksandra Urban, Levittown, PA (US)

( * ) Notice: Subject to any disclaimer, the term of this patent is extended or adjusted under 35 U.S.C. 154(b) by 189 days.

(21) Appl. No.: 13/684,154

(22) Filed: Nov. 21, 2012

(65) Prior Publication Data

US 2013/0170890 A1 Jul. 4, 2013

Related U.S. Application Data

(60) Provisional application No. 61/561,976, filed on Nov. 21, 2011.

(51) Int. Cl.
*A47K 7/03* (2006.01)
*A47K 7/04* (2006.01)

(52) U.S. Cl.
CPC .. *A47K 7/043* (2013.01); *A47K 7/03* (2013.01)

(58) Field of Classification Search
CPC ..... A47K 7/03
USPC ..... 401/201; 383/57
See application file for complete search history.

(56) References Cited

U.S. PATENT DOCUMENTS

| | | | | |
|---|---|---|---|---|
| 2,829,392 | A * | 4/1958 | Dupuy | 401/201 |
| 3,377,121 | A * | 4/1968 | Billesbach et al. | 401/7 |
| 5,031,759 | A | 7/1991 | Ogilvie | |
| 5,326,610 | A * | 7/1994 | Moss | 428/78 |
| 6,227,742 | B1 | 5/2001 | Corn et al. | |
| 6,644,881 | B1 * | 11/2003 | Dawan | 401/201 |
| 6,998,373 | B1 * | 2/2006 | Faines et al. | 510/141 |
| 7,473,044 | B2 | 1/2009 | Collins | |
| 2002/0025215 | A1 * | 2/2002 | Duden et al. | 401/201 |
| 2004/0126177 | A1 * | 7/2004 | Puvvada et al. | 401/201 |
| 2009/0110466 | A1 * | 4/2009 | Thomas et al. | 401/201 |
| 2012/0191108 | A1 * | 7/2012 | Thomas | 606/131 |

* cited by examiner

*Primary Examiner* — Kevin P Shaver
*Assistant Examiner* — Joshua Wiljanen
(74) *Attorney, Agent, or Firm* — LaMorte & Associates, P.C.

(57) ABSTRACT

A soap holding device for holding a bar of soap. A water permeable sheet of material is provided that has a periphery defined by a first edge, a second edge, and two side edges. The sheet of material is folded to have overlapping sections so that the sheet of material proximate the first edge overlaps the sheet of material proximate the second edge. The side edges are sealed closed to define an internal pocket within the soap holder that is only accessible through an open slot. The open slot extends between the overlapping sections from the first edge and the second edge. A bar of soap can be inserted into the internal pocket by sliding the bar of soap between the overlapping sections. Once the bar of soap is inside the internal pocket, it becomes trapped.

13 Claims, 6 Drawing Sheets

DEVICE FOR HOLDING SOAP

RELATED APPLICATIONS

This application claims priority of U.S. Provisional Patent Application No. 61/561,976, entitled Device For Holding Soap, filed Nov. 21, 2011.

BACKGROUND OF THE INVENTION

1. Field of the Invention

In general, the present invention relates to devices that are used to hold bars of soap and fragments of bars of soap. More particularly, the present invention relates to devices that hold a bar of soap while a person is washing with the bar of soap.

2. Prior Art Description

Soap, by its nature, is slippery and difficult to hold. Furthermore, as a bar of soap wears away, it has a tendency to become soft as the soap becomes saturated with water. This makes the bar of soap feel like paste, rather than a bar of soap. Furthermore, as the soap wears away, it often becomes too small to hold effectively. What remains are small fragments of soap. As a result, many people throw away soap when it becomes too small or too soft. This wastes soap.

In the prior art, there are many devices that are intended to hold bars of soap. Some of these devices are simple porous bags that surround the bar of soap. Such prior art is exemplified by U.S. Pat. No. 5,031,759 to Ogilvie, entitled Soap-Holding Bag. Other prior art devices have soap holders that are attached to handles and straps so that the bar of soap becomes easier to hold and manipulate during bathing. Such prior art soap holders are exemplified by U.S. Pat. No. 6,227,742 to Corn, entitled Device For Use In Washing The Back Of A Person; and U.S. Pat. No. 7,473,044 to Collins, entitled Soap Holder And Body Washing Device Including Gripping Strap And Associated Methods.

A problem associated with such prior art soap holding devices is that the bar of soap is placed in a pocket. The pocket may be drawn closed with a string, but a small opening inevitably exists. This opening widens as the soap holding device is manipulated during washing. As the bar of soap becomes small and/or gets soft, the soap tends to exit the soap holding device through the opening of the pocket. As such, some soap gets wasted.

A need therefore exists for a system and method for retaining soap in a holder, so that a bar of soap is easy to grasp and use throughout the entire life of the bar of soap. This need is met by the present invention as described and claimed below.

SUMMARY OF THE INVENTION

The present invention is a soap holding device for holding a bar of soap or remnants of bars of soap when washing. A water permeable sheet of material is provided that has a periphery defined by a first edge, a second edge, and two side edges that extend between the first edge and the second edge. The sheet of material is preferably rectangular in shape, where the side edges are longer than the first edge and the second edge. The sheet of material is folded to have overlapping sections so that the sheet of material proximate the first edge overlaps the sheet of material proximate the second edge. The side edges are sealed closed to define an internal pocket within the soap holder that is only accessible through an open slot. The open slot extends between the overlapping sections from the first edge to the second edge.

A bar of soap can be inserted into the internal pocket by sliding the bar of soap between the overlapping sections.

Once the bar of soap is inside the internal pocket, it becomes trapped. The bar of soap creates soapy water that permeates through the sheet of material. In this manner, the soap holder can be used directly as if it were a bar of soap.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention soap holder can be embodied in many ways, the embodiment illustrated shows the soap holder sized to retain a standard bar of bathing soap. This embodiment is selected in order to set forth the best mode contemplated for the invention. The illustrated embodiment, however, is merely exemplary and should not be considered a limitation when interpreting the scope of the appended claims.

Figure 1:
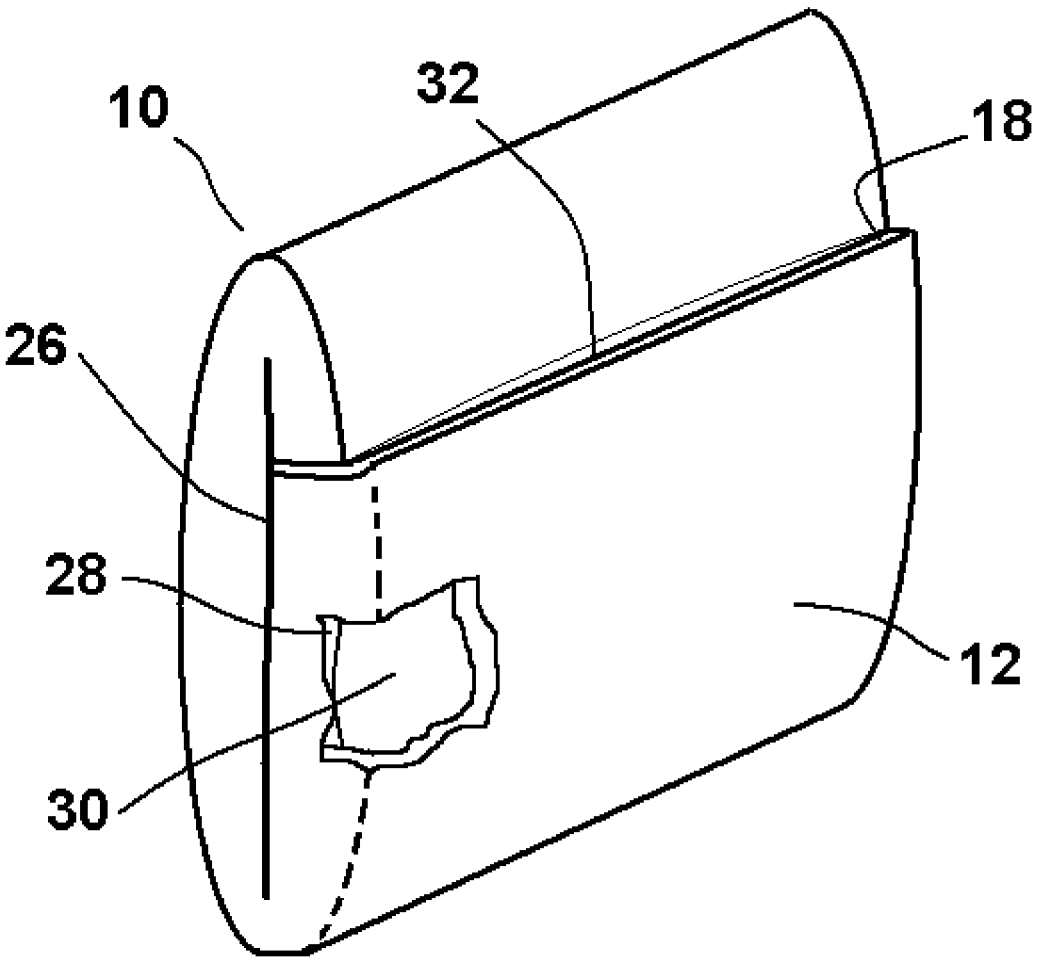
FIG. 1 is a perspective view of an exemplary embodiment of a soap holder.
Figure 2:
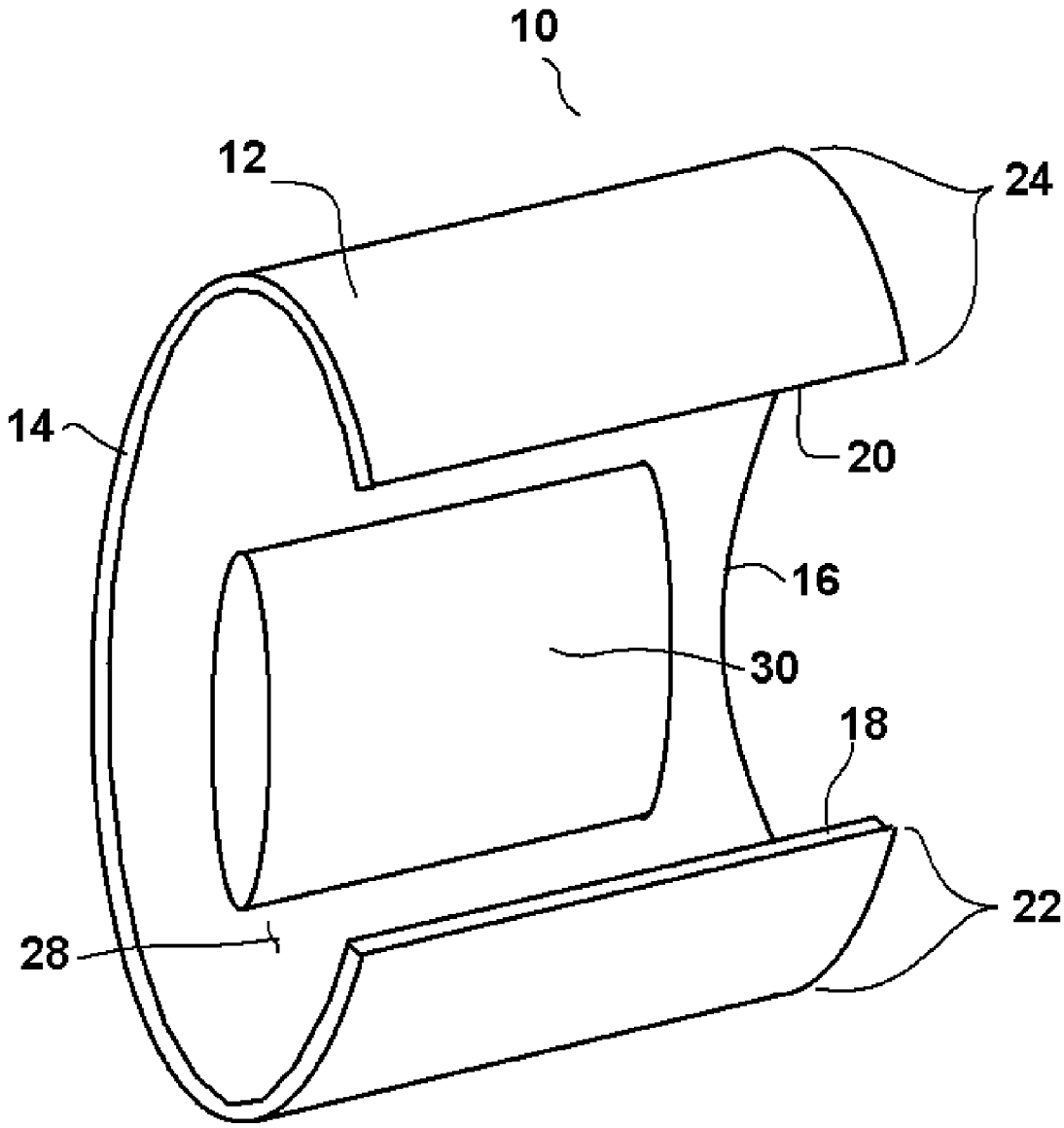
FIG. 2 is an exploded view of the embodiment of FIG. 1.

Referring to FIG. 1 in conjunction with FIG. 2, a soap holder 10 is provided. The soap holder 10 is fabricated from a single length of material 12. The length of material 12 is initially rectangular in shape, having a periphery defined by two long side edges 14, 16, a first short edge 18 and a second short edge 20. Since the length of material 12 is rectangular, the two long side edges 14, 16 are parallel, as are the first short edge 18 and the second short edge 20. The length of material 12 is folded over so that overlapping sections 22, 24 proximate the first short edge 18 and the second short edge 20 abut, respectively. The long side edges 14, 16 are neatly tucked and sewn together to form closed side seams 26.

Preferably, the length of material 12 is made of open-cell foam. However, other water permeable materials, such as cotton cloth, can be used. Since the soap holder 10 is preferably made from open-cell foam material, it will be understood that the soap holder 10 is both air permeable and water permeable. The open-cell foam material, itself, is preferably between 0.125 inches thick and 0.50 inches thick.

The length of material 12 is folded to form the soap holder 10. The folded length of material 12 creates an internal pocket 28 in the center of the soap holder 10. The side seams 26 of the soap holder 10 are sewn or otherwise adhered closed. This seals the sides of the internal pocket 28. Accordingly, the only way to access the internal pocket 28 is to slide a bar of soap 30, or fragments of bars of soap, between the overlapping sections 22, 24 between the first short edge 18 and the second short edge 20.

Figure 3:
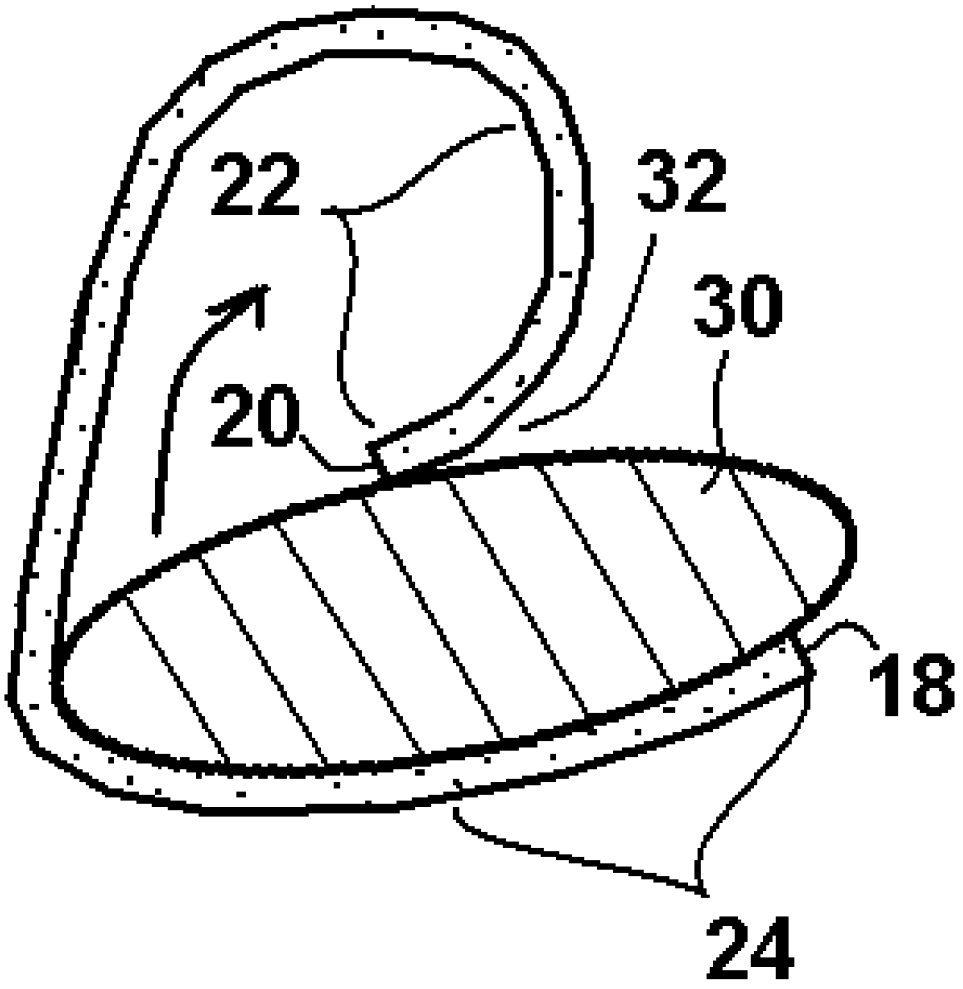
FIG. 3, FIG. 4 and FIG. 5 show cross-sectional views that illustrate how a bar of soap is inserted into the exemplary embodiment of the soap holder.
Figure 4:
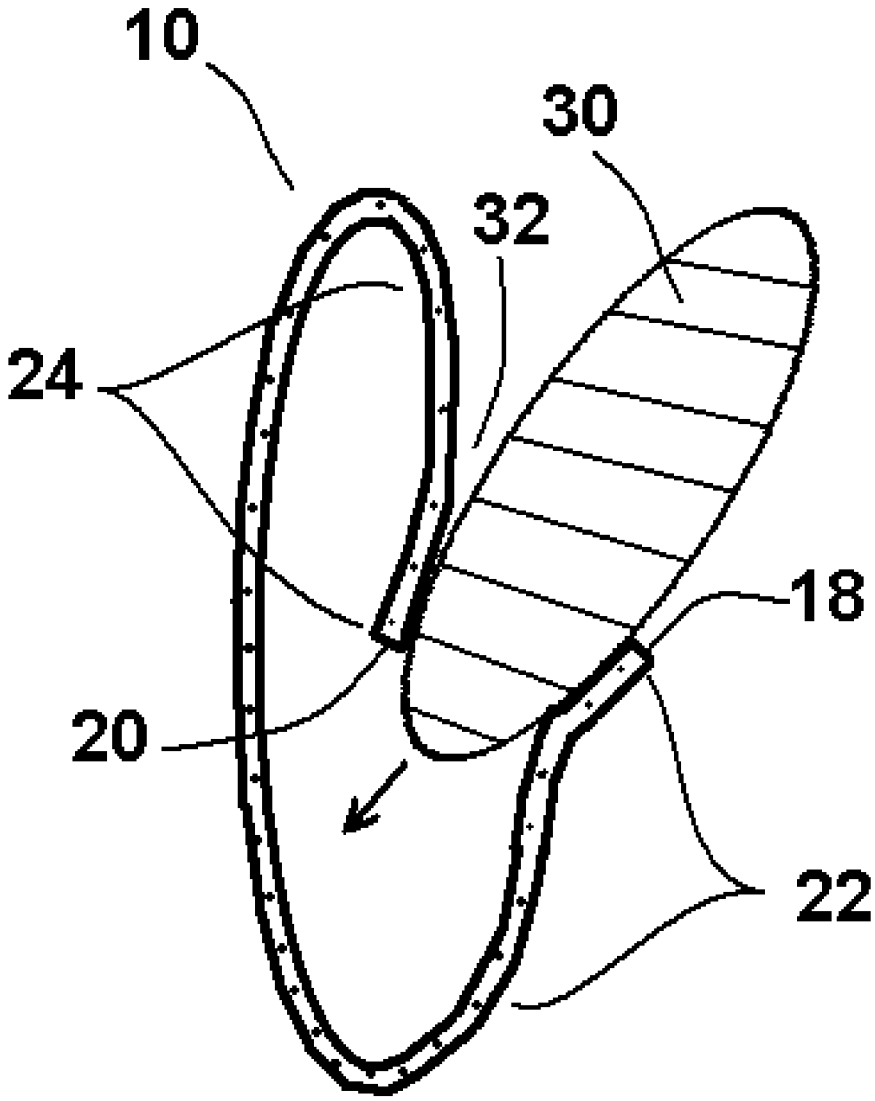
Figure 5:
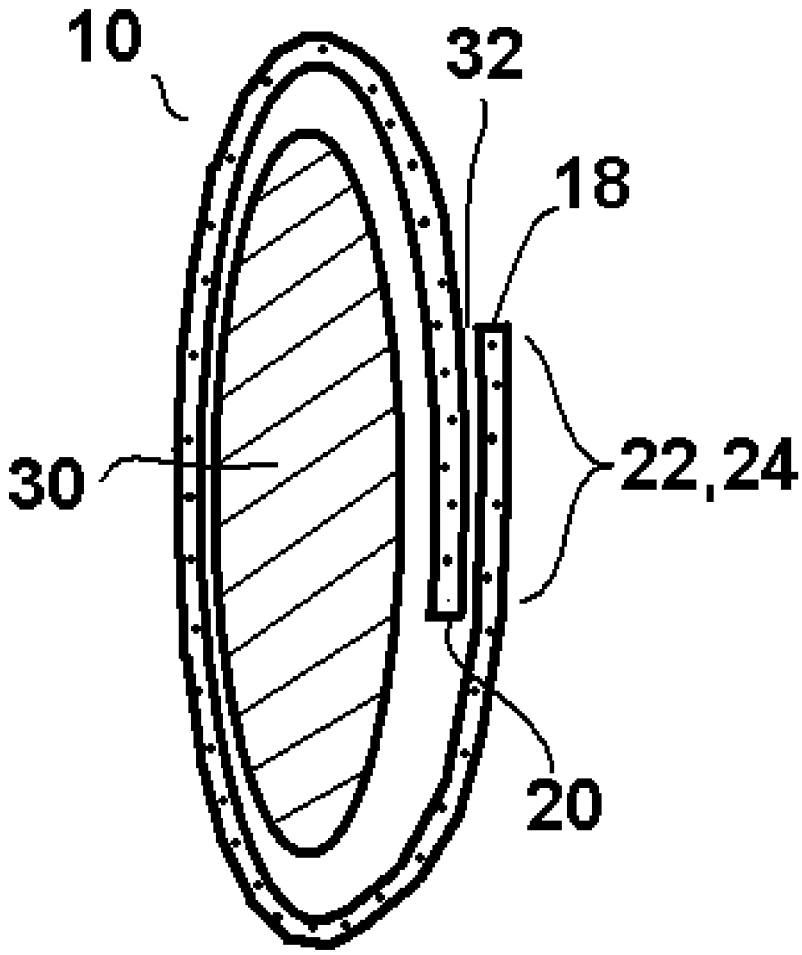

Referring to FIGS. 3, 4 and 5 in conjunction with FIG. 1, it can be seen that the overlapping sections 22, 24 create a slot opening 32 that leads into the internal pocket 28. The slot opening 32 extends between the first short edge 18 and the second short edge 20. The first short edge 18 is on the exterior of the soap holder 10, and the second short edge 20 is on the interior of the soap holder 10. The bar of soap 30 is initially introduced into the slot opening 32 at the first short edge 18. See FIG. 3. The bar of soap 30 is pressed through the slot opening 32 until the bar of soap 30 passes between the overlapping sections 22, 24 and clears the second short edge 20. See FIG. 4. The bar of soap 30 is then turned into the internal pocket 28. See FIG. 5.

Once the bar of soap 30 is inserted through the slot opening 32 and into the internal pocket 28, the presence of the bar of soap 30 helps keep the slot opening 32 closed. Furthermore, as the soap holder 10 is held in a person's hand and used for washing, the contact forces press the slot opening 32 closed. Accordingly, the bar of soap 30 becomes trapped within the internal pocket 28. The bar of soap 30 cannot inadvertently fall out of the internal pocket 28 regardless of how small or how soft the bar of soap 30 becomes. The bar of soap 30 can be intentionally removed by a user. However, absent the intentional removal of the bar of soap 30, the only way for the bar of soap 30 to leave the internal pocket 28 is for the bar of soap 30 to dissolve in water and permeate through the surrounding length of material 12 as soapy water.

Since the surrounding length of material 12 is water permeable, it will be understood that water can penetrate the soap holder 10 and contact the bar of soap 30 inside the internal pocket 28. The water can then dissolve some of the bar of soap 30 and the soapy water can permeate to the surface of the soap holder 10. The result is that the soap holder 10 has a soapy exterior surface when wet. Accordingly, the soap holder 10 can be used as though it were itself a bar of soap. The soap holder 10 can be grasped in a user's hands and run against any body part in the same manner as the bar of soap 30. However, the length of material 12 comprising the soap holder 10, although soapy, is far less slippery than the surface of the actual bar of soap. As a result, the soap holder 10 is far less likely to be dropped by a user than is an actual bar of soap or soap bar fragments.

Figure 6:
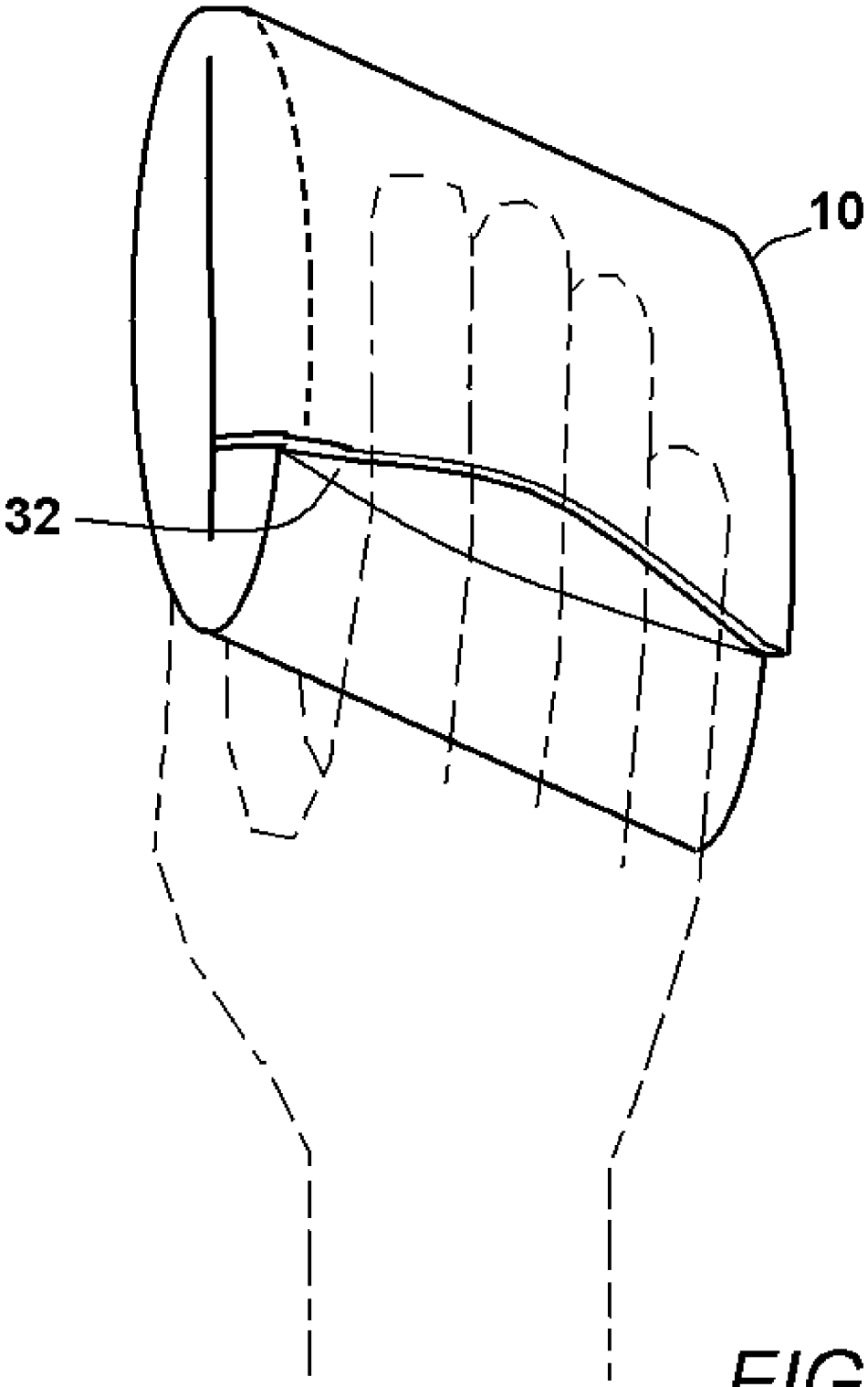
FIG. 6 shows a hand engaged with the exemplary embodiment of the soap holder.

Referring to FIG. 6 in conjunction with FIG. 5, it can be seen that since the soap holder 10 has a slot opening 32 for inserting the bar of soap 30 into the soap holder 10, a user can place his/her fingers into that same slot opening 32. Consequently, when a person is using the soap holder 10, the soap holder 10 can be affixed to that person's hand. This makes the soap holder 10 far easier to hold in position, especially when a person is washing a hard-to-reach body part.

Since the bar of soap 30 is held inside the internal pocket 28, the bar of soap 30 will continue to produce soapy water until the entire bar of soap 30 is dissolved. Accordingly, all of the bar of soap 30 can be used, regardless of the size or consistency of the bar of soap 30. Likewise, left over fragments of old bars of soap 30 can be placed in the soap holder 10 and used until the fragments fully dissolve.

In the figures of the invention presented, the soap holder 10 is directly held by a person. The soap holder 10 is only slightly larger than the bar of soap 30 it holds. This enables the soap holder 10 to be placed on soap trays and similar supports that are sized to hold a bar of soap. However, it should be understood that auxiliary items can be attached to the soap holder 10. For example, the soap holder 10 can be centered between two extending straps that enable the soap holder 10 be used as a back scrubber or a foot washer. Likewise, the soap holder 10 can be attached to the end of a stick and used in the same manner as a handled brush.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A soap holding device, comprising:

a rectangular sheet of water permeable material having a periphery defined by a first long edge, a second long edge, a first short edge and a second short edge, wherein said sheet of water permeable material defines an internal pocket by folding a first overlapping section, proximate said first short edge, over a second overlapping section, proximate said second short edge, wherein said first long edge is tucked into said internal pocket and sealed along a first side seam, and wherein said second long edge is tucked into said internal pocket and sealed along a second side seam, and wherein said first short edge extends from said first side seam to said second side seam across said second overlapping section, wherein an open slot extends between said first overlapping section and said second overlapping section that is accessible along said first short edge.

2. The device according to claim 1, wherein said first short edge and said second short edge are parallel.

3. The device according to claim 2, wherein said first long edge and said second side long edge are parallel.

4. The device according to claim 1, wherein said sheet of water permeable material is fabricated from an open cell foam.

5. The device according to claim 1, wherein said sheet of water permeable material is fabricated from cotton cloth.

6. The device according to claim 1, wherein said internal pocket is sized to receive and retain a bar of soap.

7. The device according to claim 1, wherein said first side seam and said second side seam are sewn closed along parallel lines.

8. A soap holding device, comprising:

a bar of soap;

a rectangular sheet of water permeable material having a periphery defined by a first short edge, a second short edge, a first long edge and a second long edge, wherein said sheet of water permeable material is wrapped around said bar of soap to form an internal pocket having a first overlapping section, proximate said first short edge, and a second overlapping section, proximate said second short edge, wherein said first long edge is tucked into said internal pocket and sealed along a first side seam, and wherein said second long edge is tucked into said internal pocket and sealed along a second side seam, and wherein said first short edge extends from said first side seam to said second side seam across said second overlapping section, wherein said bar of soap is only accessible through an open slot that extends along said first short edge between said first side seam and said second side seam.

9. The device according to claim 8, wherein said first short edge and said second short edge are parallel.

10. The device according to claim 9, wherein said first long edge and said second long edge are parallel.

11. The device according to claim 8, wherein said sheet of water permeable material is fabricated from an open cell foam.

12. The device according to claim 8, wherein said sheet of water permeable material is fabricated from porous cloth.

13. The device according to claim 8, wherein said first side seam and said second side seam are sewn closed.

* * * * *